US010965104B2

(12) United States Patent
Sumoyama et al.

(10) Patent No.: US 10,965,104 B2
(45) Date of Patent: Mar. 30, 2021

(54) SPARK PLUG

(71) Applicant: NGK Spark Plug Co., Ltd., Nagoya (JP)

(72) Inventors: Daisuke Sumoyama, Nagoya (JP); Kazuki Ito, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 16/966,093

(22) PCT Filed: Sep. 3, 2019

(86) PCT No.: PCT/JP2019/034508
§ 371 (c)(1),
(2) Date: Jul. 30, 2020

(87) PCT Pub. No.: WO2020/095525
PCT Pub. Date: May 14, 2020

(65) Prior Publication Data

US 2021/0036493 A1 Feb. 4, 2021

(30) Foreign Application Priority Data

Nov. 9, 2018 (JP) ..... JP2018-211057

(51) Int. Cl.
*H01T 13/39* (2006.01)
*C22C 19/05* (2006.01)

(52) U.S. Cl.
CPC ..... *H01T 13/39* (2013.01); *C22C 19/058* (2013.01)

(58) Field of Classification Search
CPC ..... H01T 13/39
(Continued)

(56) References Cited

U.S. PATENT DOCUMENTS

2010/0264801 A1 10/2010 Tanaka et al.
2012/0217433 A1* 8/2012 Yokoyama ..... H01T 13/39 252/71
(Continued)

FOREIGN PATENT DOCUMENTS

JP 2003-105467 A 4/2003
JP 2007-173116 A 7/2007
(Continued)

OTHER PUBLICATIONS

International Search Report from corresponding International Patent Application No. PCT/JP2019/034508, dated Nov. 26, 2019.
(Continued)

*Primary Examiner* — Christopher M Raabe
(74) *Attorney, Agent, or Firm* — Kusner & Jaffe

(57) ABSTRACT

A spark plug capable of avoiding a discharge member bonded to a base material from peeling off easily is provided. The spark plug includes: a first electrode including a base material and a discharge member having at least a portion thereof bonded to the base material with a diffusing layer interposed therebetween; and a second electrode facing the discharge member with a spark gap interposed therebetween. The base material contains 50 mass % or more of Ni, 8 mass % or more and 40 mass % or less of Cr, 0.05 mass % or more and 2 mass % or less of Si, 0.01 mass % or more and 2 mass % or less of Al, 0.01 mass % or more and 2 mass % or less of Mn, 0.01 mass % or more and 0.1 mass % or less of C, and 0.001 mass % or more and 0.04 mass % or less of Fe.

5 Claims, 5 Drawing Sheets

(58) Field of Classification Search
USPC ..... 313/141
See application file for complete search history.

(56) References Cited

U.S. PATENT DOCUMENTS

| | | | | |
|---|---|---|---|---|
| 2013/0078136 | A1* | 3/2013 | Hattendorf | C22C 19/057 420/443 |
| 2016/0032425 | A1* | 2/2016 | Hattendorf | C22C 19/058 420/443 |
| 2017/0063048 | A1 | 3/2017 | Gozawa et al. | |

FOREIGN PATENT DOCUMENTS

| | | | |
|---|---|---|---|
| JP | 2014-229429 | A | 12/2014 |
| JP | 2017-050129 | A | 3/2017 |
| WO | WO 2009/081563 | A1 | 7/2009 |

OTHER PUBLICATIONS

Office Action dated Feb. 2, 2021 from corresponding Japanese Patent Appl. No. P2018-211057.

* cited by examiner

SPARK PLUG

FIELD OF THE INVENTION

The present invention relates to a spark plug and relates, in particular, to a spark plug in which at least a portion of a discharge member is bonded to a base material with a diffusion layer interposed therebetween.

BACKGROUND OF THE INVENTION

As a result of increased performance, improved combustion efficiency, and the like of engines, the temperature of electrodes of spark plugs under usage environment tends to become high. In a spark plug in which a first electrode including a discharge member bonded to a base material faces a second electrode with a spark gap interposed therebetween, an increase in the temperature of the first electrode increases a thermal stress of a bonded part of the discharge member, and there is thus a concern of peel-off of the discharge member. Here, in the technology disclosed in Japanese Unexamined Patent Application Publication No. 2003-105467 ("PTL 1"), a base material contains 0.05 mass % or more and 5 mass % or less of Fe thereby while improving high-temperature strength and high-temperature corrosion resistance, suppressing peel-off of a discharge member. In an example in Japanese Unexamined Patent Application Publication No. 2007-173116 ("PTL 2"), a base material contains 2 mass % of Fe to ensure the high-temperature strength of the base material, thereby suppressing peel-off of a discharge member.

The aforementioned technology is, however, found to have a possibility of not being able to sufficiently ensure the peeling resistance of the discharge member under a further temperature increase of electrodes. In other words, in the bonded part between the base material and the discharge member, a thermal stress due to a difference in thermal expansion coefficient therebetween is generated, and a crack is easily generated. If oxygen enters the crack, the oxygen binds to Fe derived from the base material, and an iron oxide is generated in the bonded part between the base material and the discharge member. Under usage environment of an engine, the volume of the iron oxide changes in response to the crystal structure thereof being changed by oxidation reduction. Thus, the stress of the bonded part between the base material and the discharge member is further increased. Consequently, there is a possibility of the discharge member easily peeling off from the base material.

In particular, in an electrode in which at least a portion of a discharge member is bonded to a base material with a diffusion layer interposed therebetween, the stress buffering effect of the diffusion layer is poor compared with an electrode in which a discharge member is bonded to a base material with a laser-welded fused portion interposed therebetween. Therefore, there is a possibility of the discharge member peeling off more easily.

SUMMARY OF THE INVENTION

The present invention has been made to solve the above-mentioned problem, and an object thereof is to provide a spark plug capable of avoiding a discharge member bonded to a base material from peeling off easily.

Solution to Problem

To achieve the object, a spark plug according to the present invention includes: a first electrode including a base material and a discharge member having at least a portion thereof bonded to the base material with a diffusion layer interposed therebetween; and a second electrode facing the discharge member with a spark gap interposed therebetween. The base material contains 50 mass % or more of Ni, 8 mass % or more and 40 mass % or less of Cr, 0.05 mass % or more and 2 mass % or less of Si, 0.01 mass % or more and 2 mass % or less of Al, 0.01 mass % or more and 2 mass % or less of Mn, 0.01 mass % or more and 0.1 mass % or less of C, and 0.001 mass % or more and 0.04 mass % or less of Fe.

Advantageous Effects of Invention

According to a spark plug described in a first aspect, the base material contains 0.001 mass % or more and 0.04 mass % or less of Fe and contains 0.05 mass % or more and 2 mass % or less of Si having higher affinity for oxygen than Fe. It is thus possible to suppress an iron oxide from being generated along the interface between the diffusion layer and the discharge member and the interface between the diffusion layer and the base material and in the diffusion layer while suppressing the base material from becoming brittle. Consequently, it is possible to ensure the strength of the base material and to further reduce the stress of the diffusion layer due to the volume change of the iron oxide. It is thus possible to avoid the discharge member bonded to the base material from peeling off easily.

According to the spark plug described in a second aspect, the base material contains 22 mass % or more and 28 mass % or less of Cr, 0.7 mass % or more and 1.3 mass % or less of Si, 0.6 mass % or more and 1.2 mass % or less of Al, 0.1 mass % or more and 1.1 mass % or less of Mn, and 0.01 mass % or more and 0.07 mass % or less of C. Consequently, it is possible to further avoid the discharge member from peeling off easily.

According to the spark plug described in third and fourth aspects, when X (mass %) represents a content ratio of the Si of the base material and Y (mass %) represents a content ratio of the Fe of the base material, $2.5 \leq X/Y$ is satisfied. The Si contained in the base material can improve the effect of suppressing oxidization of the Fe and the volume change of the iron oxide. It is thus possible to further avoid the discharge member from peeling off easily.

According to the spark plug described in a fifth aspect, the base material includes a solid solution containing Ni, the solid solution including a segregate present therein, and, in a cross-section of the base material, an area of the segregate occupying an area of the base material is 0.01% or more and 4% or less. It is possible by ensuring the high-temperature strength of the base material to further avoid the discharge member from peeling off easily.

DETAILED DESCRIPTION OF THE INVENTION

Figure 1:
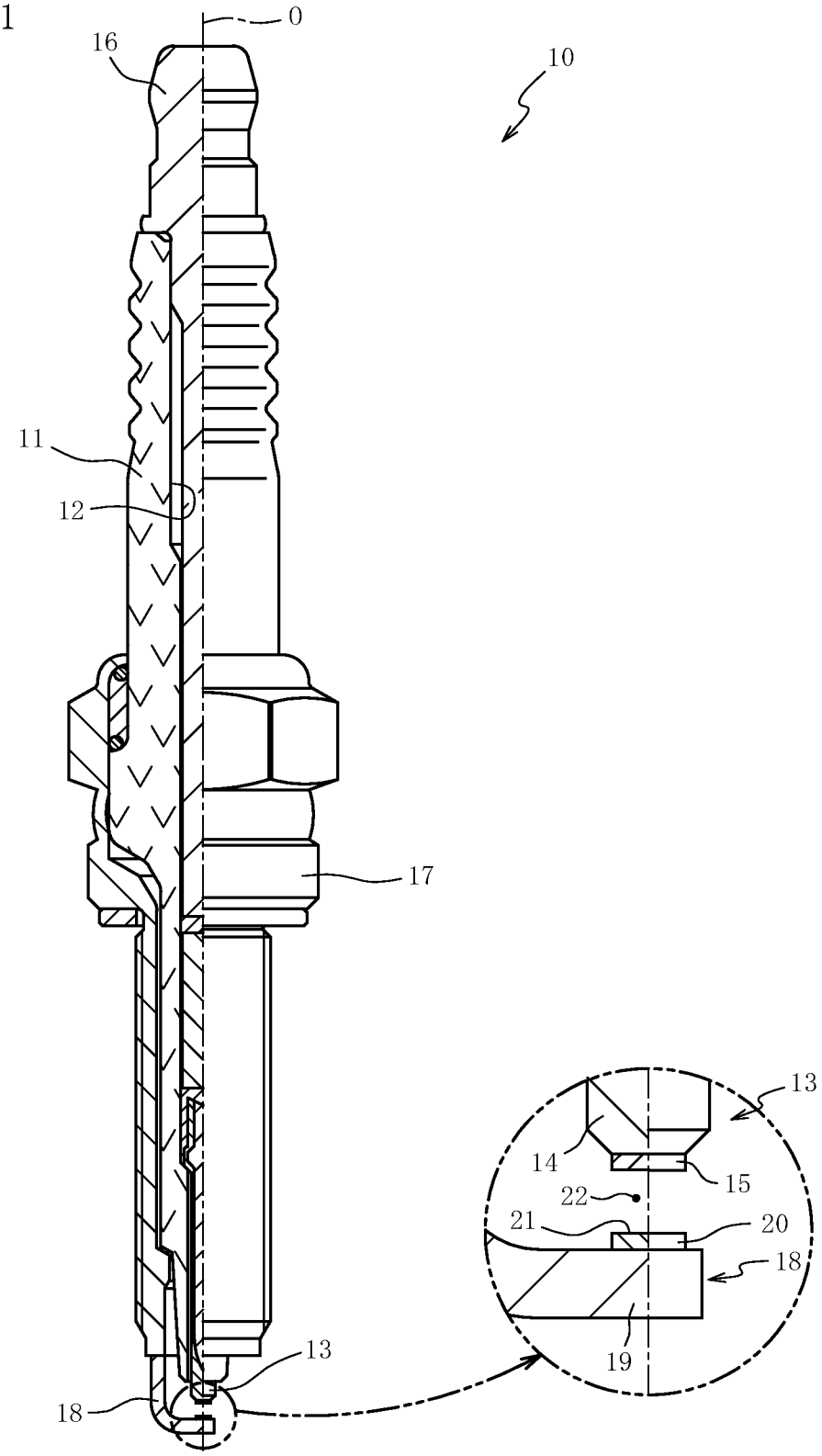
FIG. 1 is a half sectional view of a spark plug according to an embodiment.

Hereinafter, a preferable embodiment of the present invention will be described with reference to the attached drawings. FIG. 1 is a half sectional view of a spark plug 10 according to an embodiment with an axis O as the boundary. The lower side of FIG. 1 is referred to as the front-end side of the spark plug 10, and the upper side of FIG. 1 is referred to as the rear end side of the spark plug 10 (the same applies to FIG. 2).

As illustrated in FIG. 1, the spark plug 10 includes an insulator 11, a center electrode 13 (second electrode), a metal shell 17, and a ground electrode 18 (first electrode). The insulator 11 is a substantially cylindrical member excellent in mechanical characteristics and insulation properties under high temperatures and formed of alumina or the like. The insulator 11 has an axial hole 12 extending therethrough along the axis O.

The center electrode 13 is a bar-shaped electrode inserted into the axial hole 12 and held by the insulator 11. The center electrode 13 includes a base material 14 and a discharge member 15 bonded to the front end of the base material 14. In the base material 14, a core material having excellent thermal conductivity is embedded. The base material 14 is formed of an alloy mainly constituted by Ni or a metal material constituted by Ni. The core material is formed of copper or an alloy containing copper as a main component. It is of course possible to omit the core material. The discharge member 15 is formed of, for example, a noble metal, such as Pt, Ir, Ru, Rh, and the like, or W, which has spark-wear resistance higher than that of the base material 14, or an alloy mainly constituted by such a noble metal or W.

A metal terminal 16 is a bar-shaped member to which a high-voltage cable (not illustrated) is connected, and the front-end side of the metal terminal 16 is disposed in the insulator 11. The metal terminal 16 is electrically connected in the axial hole 12 to the center electrode 13.

The metal shell 17 is a substantially cylindrical metallic member fixed to a screw hole (not illustrated) of an internal combustion engine. The metal shell 17 is formed of a metal material (for example, low-carbon steel or the like) having conductivity. The metal shell 17 is fixed to the outer periphery of the insulator 11. The ground electrode 18 is connected to the front end of the metal shell 17.

The ground electrode 18 includes a base material 19 connected to the metal shell 17 and a discharge member 20 bonded to the base material 19. In the base material 19, a core material having excellent thermal conductivity is embedded. The base material 19 is formed of a metal material constituted by an alloy mainly constituted by Ni. The core material is formed of copper or an alloy containing copper as a main component. It is of course possible to omit the core material and form the entirety of the base material 19 with an alloy mainly constituted by Ni. The base material 19 contains Ni, Cr, Si, Al, Mn, C, and Fe. Note that elements other than these elements may be contained.

The discharge member 20 is formed of, for example, a noble metal, such as Pt, Ir, Ru, Rh, and the like, or W, which has spark-wear resistance higher than that of the base material 19, or an alloy mainly constituted by such a noble metal or W. A discharge surface 21 of the discharge member 20 faces the center electrode 13 with a spark gap 22 interposed therebetween. In the present embodiment, the discharge member 20 is an alloy mainly constituted by Pt and containing Ni and has a disc shape having the circular discharge surface 21.

The spark plug 10 is manufactured, for example, by the following method. First, the center electrode 13 is inserted into the axial hole 12 of the insulator 11. After the metal terminal 16 is inserted into the axial hole 12 and conductivity between the metal terminal 16 and the center electrode 13 is ensured, the metal shell 17 to which the base material 19 has been previously bonded is assembled to the outer periphery of the insulator 11. After the discharge member 20 is bonded to the base material 19 by resistance welding, the base material 19 is bent such that the discharge member 20 faces the center electrode 13 in the axial direction, thereby obtaining the spark plug 10. It is possible to subject the base material 19 to which the discharge member 20 is bonded to heat treatment after the resistance welding.

Figure 2:
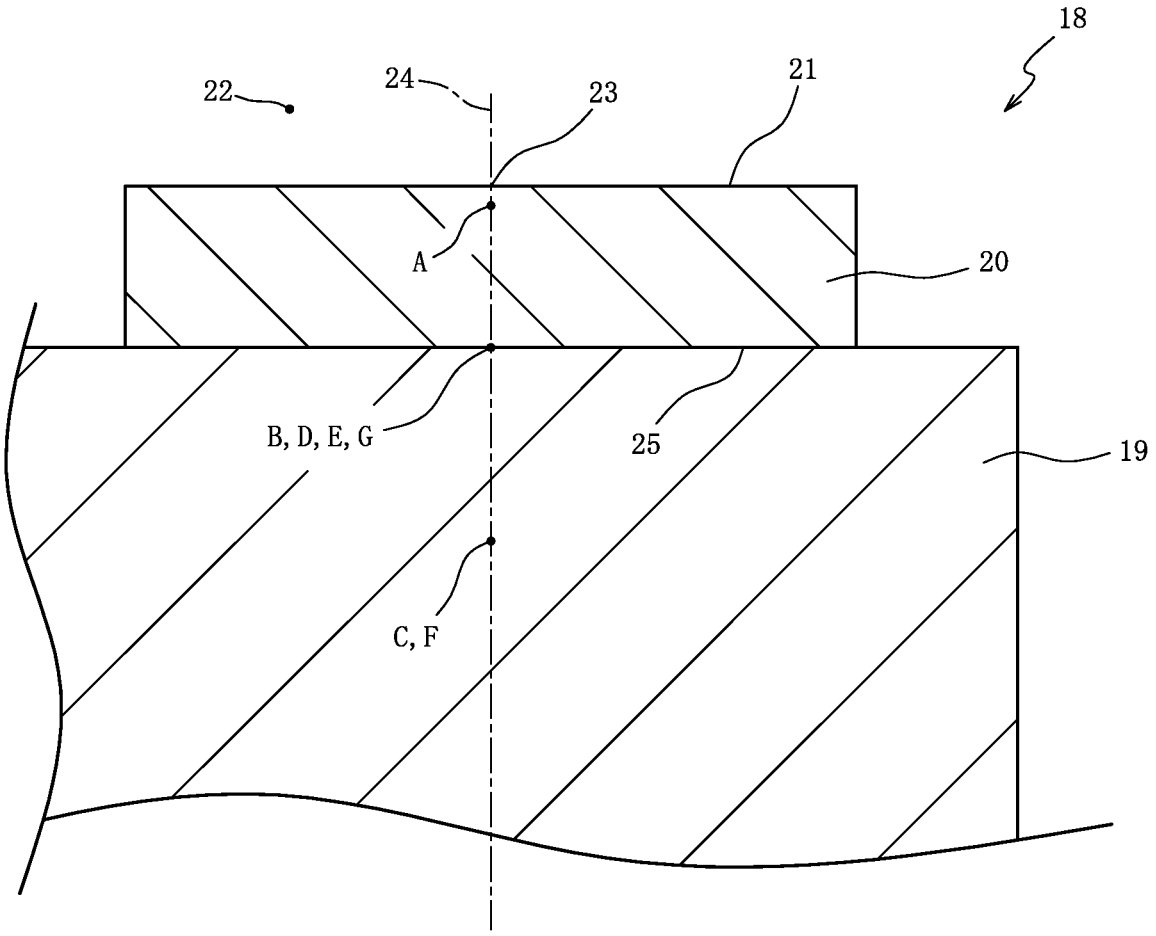
FIG. 2 is a sectional view of a ground electrode.

FIG. 2 is a sectional view of the ground electrode 18 including, of straight lines passing through a center 23 of the discharge surface 21 of the discharge member 20, the straight line 24 parallel to the axis O. In the present embodiment, the axis O of the spark plug 10 is coincident with the straight line 24. At least a portion of the discharge member 20 is bonded to the base material 19 with a diffusion layer 25 interposed therebetween. The diffusion layer 25 bonds the base material 19 and the discharge member 20 to each other by diffusion of atoms (interatomic bonding) generated between the base material 19 and the discharge member 20. A fused portion in which the discharge member 20 and the base material 19 have been fused and solidified may be formed at a portion of the interface between the discharge member 20 and the base material 19. The fused portion is, however, not included in the diffusion layer 25.

Figure 3:
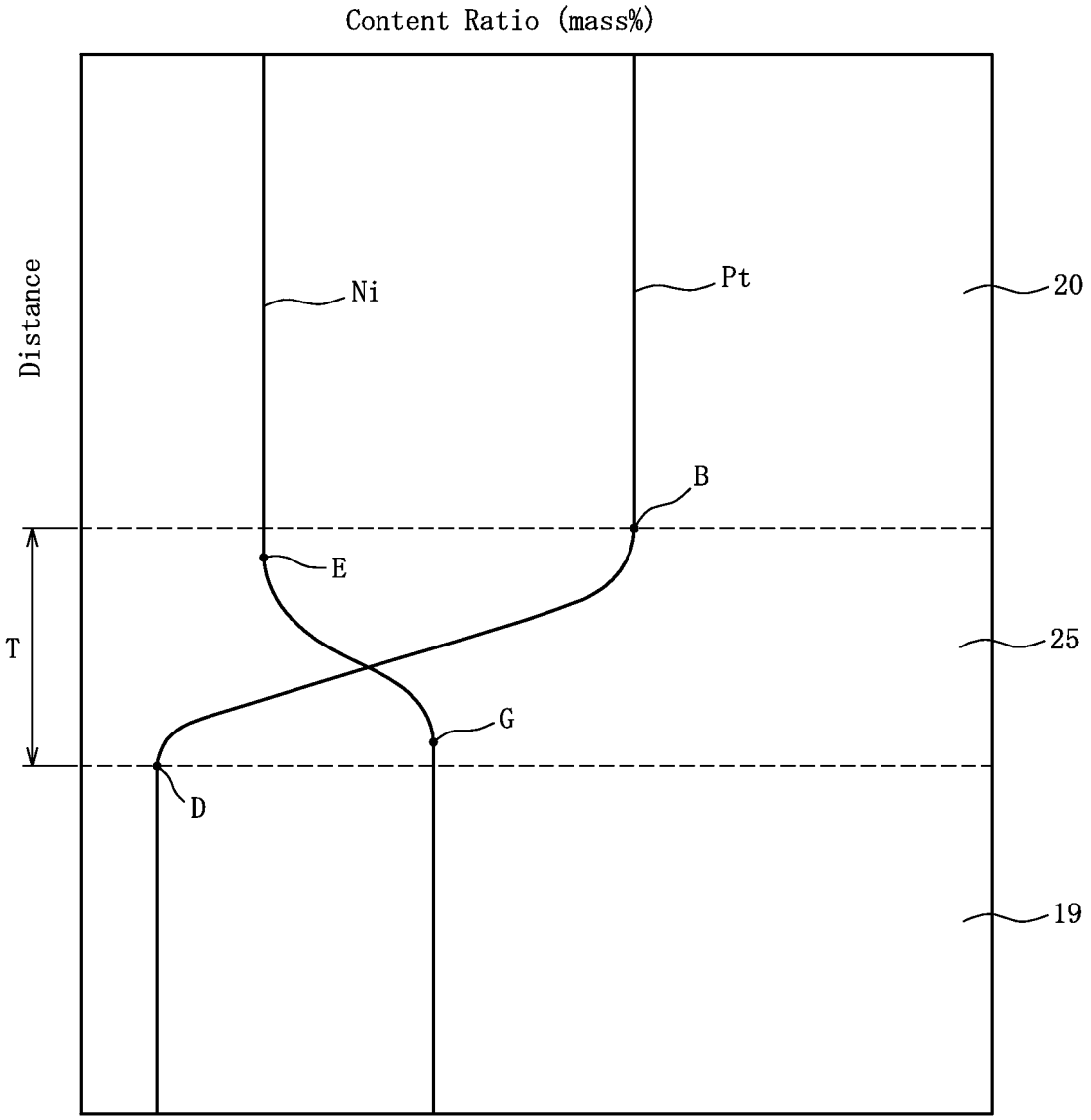
FIG. 3 illustrates element distribution in the vicinity of a diffusion layer.

FIG. 3 illustrates element distribution in the vicinity of the diffusion layer 25. In FIG. 3, the content ratios of Pt and Ni are plotted. The content ratios were measured on the straight line 24 perpendicular to the diffusion layer 25 in a polished surface of the ground electrode 18 including the straight line 24. The measurement was performed from the discharge member 20 to the base material 19 at certain (for example, 1 μm) intervals. The horizontal axis of FIG. 3 represents the content ratios (mass %) of elements, and the content ratios are lower toward the left side. The vertical axis represents the distance (that is, the position of the spark plug 10 in the direction of the axis O), and the lower side indicates the front-end side of the spark plug 10.

The content ratios of elements contained in the base material 19 and the discharge member 20 are obtainable by WDS analysis of a FE-EPMA (JXA 8500F manufactured by JEOL Ltd.) loaded with a hot cathode field emission-type electron gun. After qualitative analysis is performed by WDS analysis, mass composition is measured by performing quantitative analysis, thereby measuring content ratios (mass %) relative to the total sum of the detected mass compositions of the elements.

In the present embodiment, the base material 19 constituted by an alloy mainly constituted by Ni does not contain Pt. In contrast, the discharge member 20 is mainly constituted by Pt and contains Ni. The content ratio of Ni of the discharge member 20 is lower than the content ratio of Ni of the base material 19. It is thus possible, when distribution of Pt and Ni is known, to specify the position of the diffusion layer 25 in which atoms diffuse between the base material 19 and the discharge member 20.

In the diffusion layer 25, the diffusion of the atoms is generated due to hot press bonding between the discharge member 20 and the base material 19. In the diffusion layer 25, the content ratio of a specific element (Pt in the present embodiment) contained in the discharge member 20 continuously decreases from the discharge member 20 toward the base material 19. In the diffusion layer 25, the content ratio of a specific element (Ni in the present embodiment) contained in the base material 19 continuously decreases from the base material 19 toward the discharge member 20.

Figure 5:
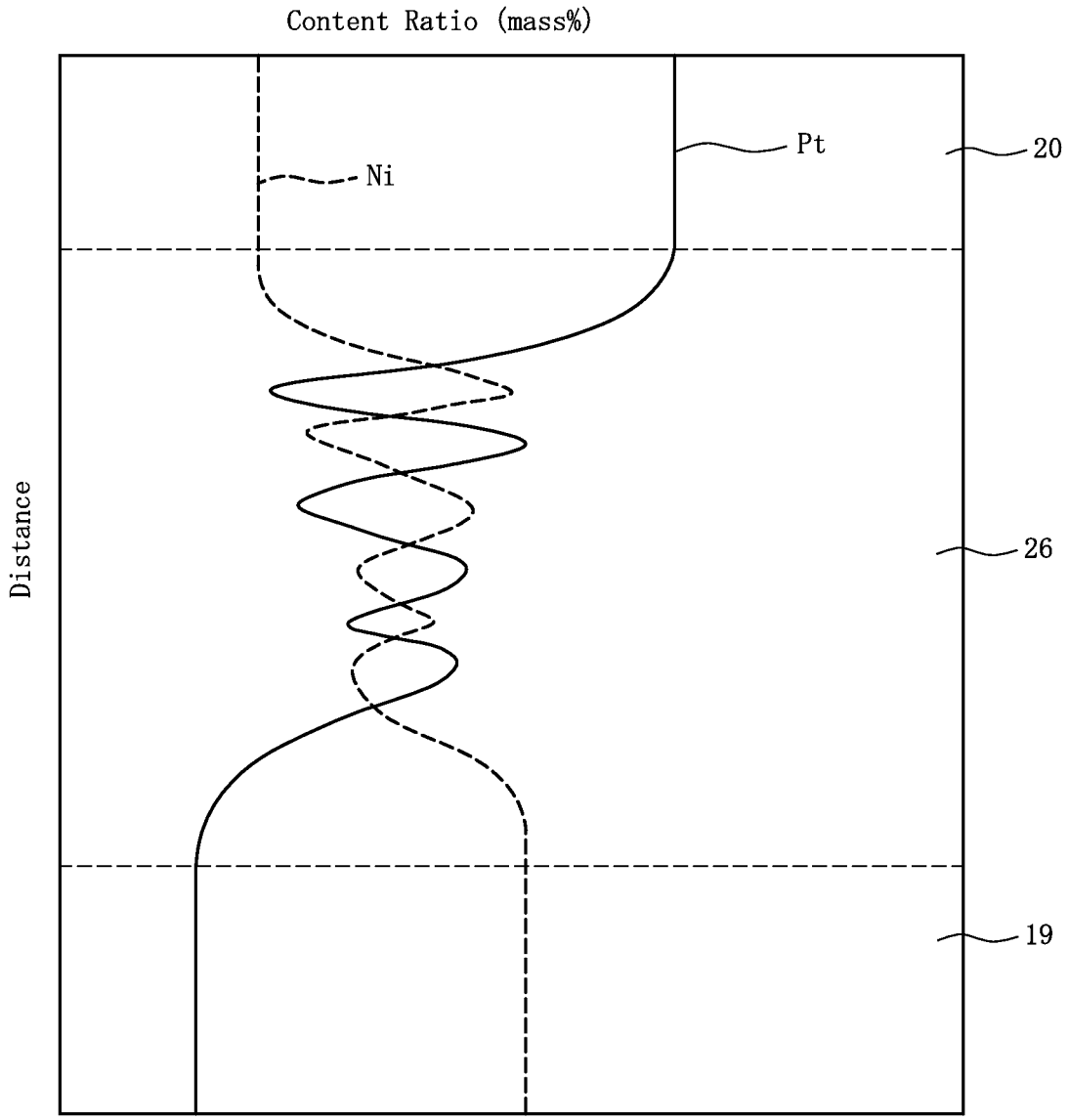
FIG. 5 illustrates element distribution in the vicinity of a fused portion.

A fused portion 26 formed by laser welding will be described. FIG. 5 illustrates element distribution in the vicinity of the fused portion 26 in a sample in which the fused portion 26 formed by laser welding is formed between the base material 19 and the discharge member 20. In FIG. 5, content ratios of Pt and Ni are plotted. The content ratios were measured from the discharge member 20 to the base material 19 across the fused portion 26 at certain (for example, 1 μm) intervals. The horizontal axis of FIG. 5 represents content ratios (mass %), and the content ratios are lower toward the left side. The vertical axis represents the distance (that is, the position of the spark plug in the direction of the axis O), and the lower side indicates the front-end side of the spark plug. In the fused portion 26, the base material 19 and the discharge member 20 that have been fused flow and solidify, and, differently from the diffusion layer 25, elements (Pt and Ni) are thereby mixed together with no relation to the distance from the discharge member 20 or the base material 19.

Referring back to FIG. 2, a method of measuring a thickness T of the diffusion layer 25 will be described. In FIG. 2, the straight line 24 passing through the center 23 of the discharge surface 21 of the discharge member 20 perpendicularly intersects the diffusion layer 25, and thus, the content ratios of Pt and Ni at measurement points on the straight line 24 are measured from the discharge member 20 to the base material 19 by WDS analysis of a FE-EPMA.

First, a measurement point A away from the discharge surface 21 of the discharge member 20 by 10 μm toward the base material 19 is set as an initial measurement point (base point) of the discharge member 20, and quantitative analysis is performed at five measurement points disposed at 10 μm intervals toward the base material 19. An average value of the content ratios of Pt at the five measurement points is considered as a content ratio W1 of Pt of the discharge member 20.

Next, quantitative analysis is performed at measurement points disposed on the straight line 24 at constant intervals (for example, 1 μm) toward the base material 19 from, of the five measurement points of the discharge member 20, the measurement point closest to the base material 19. Among the measurement points, all of the measurement points at each of which a content ratio W2 of Pt is W1 or less and at each of which the content ratios of Pt at measurement points closer than the measurement point to the base material 19 are W2 or less are determined, and, among the all of the measurement points, a measurement point B closest to the discharge member 20 is specified. The position of the measurement point B is considered as the position of the border between the discharge member 20 and the diffusion layer 25 for which Pt has been measured.

Next, a measurement point C on the straight line 24 away from the measurement point B by 100 μm in a direction away from the discharge member 20 is set as an initial measurement point (base point) of the base material 19, and quantitative analysis is performed at five measurement points disposed on the straight line 24 at 10 μm intervals in the direction away from the discharge member 20. An average value of the content ratios of Pt at the five measurement points is considered as a content ratio W3 of Pt of the base material 19.

Next, quantitative analysis is performed at measurement points disposed on the straight line 24 at constant intervals (for example, 1 μm) toward the discharge member 20 from, of the five measurement points of the base material 19, the measurement point C closest to the discharge member 20. Among the measurement points, all of the measurement points at each of which a content ratio W4 of Pt is W3 or more and at each of which the content ratios of Pt at measurement points closer than the measurement point to the discharge member 20 are W4 or more are determined, and among the all of the measurement points, a measurement point D closest to the base material 19 is specified. The position of the measurement point D is considered as the position of the border between the base material 19 and the diffusion layer 25 for which Pt has been measured. A distance in the axial direction between the measurement point B and the measurement point D is considered as a thickness T1 of the diffusion layer 25 for which Pt has been measured.

Similarly, the measurement point A away from the discharge surface 21 of the discharge member 20 by 10 μm toward the base material 19 is set as an initial measurement point (base point) of the discharge member 20, and quantitative analysis is performed at five measurement points disposed on the straight line 24 at 10 μm intervals toward the base material 19. An average value of content ratios of Ni at the five measurement points is considered as a content ratio W5 of Ni of the discharge member 20.

Next, quantitative analysis is performed at measurement points disposed on the straight line 24 at constant intervals (for example, 1 μm) toward the base material 19 from, of the five measurement points of the discharge member 20, the measurement point closest to the base material 19. Among the measurement points, all of the measurement points at each of which a content ratio W6 of Ni is W5 or more and at each of which the content ratios of Ni at measurement points closer than the measurement point to the base material 19 are W6 or more are determined, and among the all of the measurement points, a measurement point E closest to the discharge member 20 is specified. The position of the measurement point E is considered as the position of the border between the discharge member 20 and the diffusion layer 25 for which Ni has been measured.

Next, a measurement point F on the straight line 24 away from the measurement point E by 100 μm in a direction away from the discharge member 20 is set as an initial measurement point (base point) of the base material 19, and quantitative analysis is performed at five measurement points disposed on the straight line 24 at 10 μm intervals in the direction away from the discharge member 20. An average value of content ratios of Ni at the five measurement points is considered as a content ratio W7 of Ni of base material 19.

Next, quantitative analysis is performed at measurement points disposed on the straight line 24 at constant intervals (for example, 1 μm) toward the discharge member 20 from, of the five measurement points of the base material 19, the measurement point F closest to the discharge member 20. Among the measurement points, all of the measurement points at each of which a content ratio W8 of Ni is W7 or less and at each of which the content ratios of Ni at measurement points closer than the measurement point to the discharge member 20 are W8 or less are determined, and among the all of the measurement points, a measurement point G closest to the base material 19 is specified. The position of the measurement point G is considered as the position of the border between the base material 19 and the diffusion layer 25 for which Ni has been measurement. A distance in the axial direction between the measurement point E and the measurement point G is considered as a thickness T2 of the diffusion layer 25 for which Ni has been measured.

Between the thickness T2 and the thickness T1 of the diffusion layer 25 for which Pt has been measured, the larger thickness is considered as the thickness T (refer to FIG. 3) of the diffusion layer 25. The thickness T of the diffusion layer 25 is preferably 5 μm or more, considering peeling resistance of the discharge member 20, but is usually less than 70 μm.

WDS analysis of a FE-EPMA for determining mass compositions of the base material 19 and the discharge member 20 at each set of the five measurement points having the measurement point A, C, and F as respective base points is performed under conditions of an acceleration voltage of 20 kV and a spot diameter of 10 μm. WDS analysis to specify the measurement points B, D, E, and G for determining the thickness of the diffusion layer 25 is performed under conditions of an acceleration voltage of 20 kV and a spot diameter of 1 μm.

Elements to be analyzed are not limited to Pt and Ni. Elements to be analyzed may be two types of elements selected, as appropriate, from the elements contained in the base material 19 or the discharge member 20. The thickness of the diffusion layer 25 is considered to be easily measured by selecting Ni, which is a most contained element in the base material 19, and an element most contained in the discharge member 20.

Depending on the surface shape of the discharge surface 21 of the discharge member 20 or the thickness of the diffusion layer 25, there is a possibility of concentration gradient being present among the measurement points A, C, and F or a possibility of the measurement points A, C, and F being positioned in the diffusion layer 25. In such a case, the measured values at the measurement points A, C, and F do not represent the compositions of the discharge member 20 and the base material 19. Measurement is thus performed with the positions of the measurement points A, C, and F changed, as appropriate. In short, the measurement point A can be determined at any portion as long as measured values that represent the composition of the discharge member 20 before bonding are obtainable, and the measurement points C and F can be determined at any portions as long as measured values that represent the composition of the base material 19 before bonding are obtainable.

Figure 4:
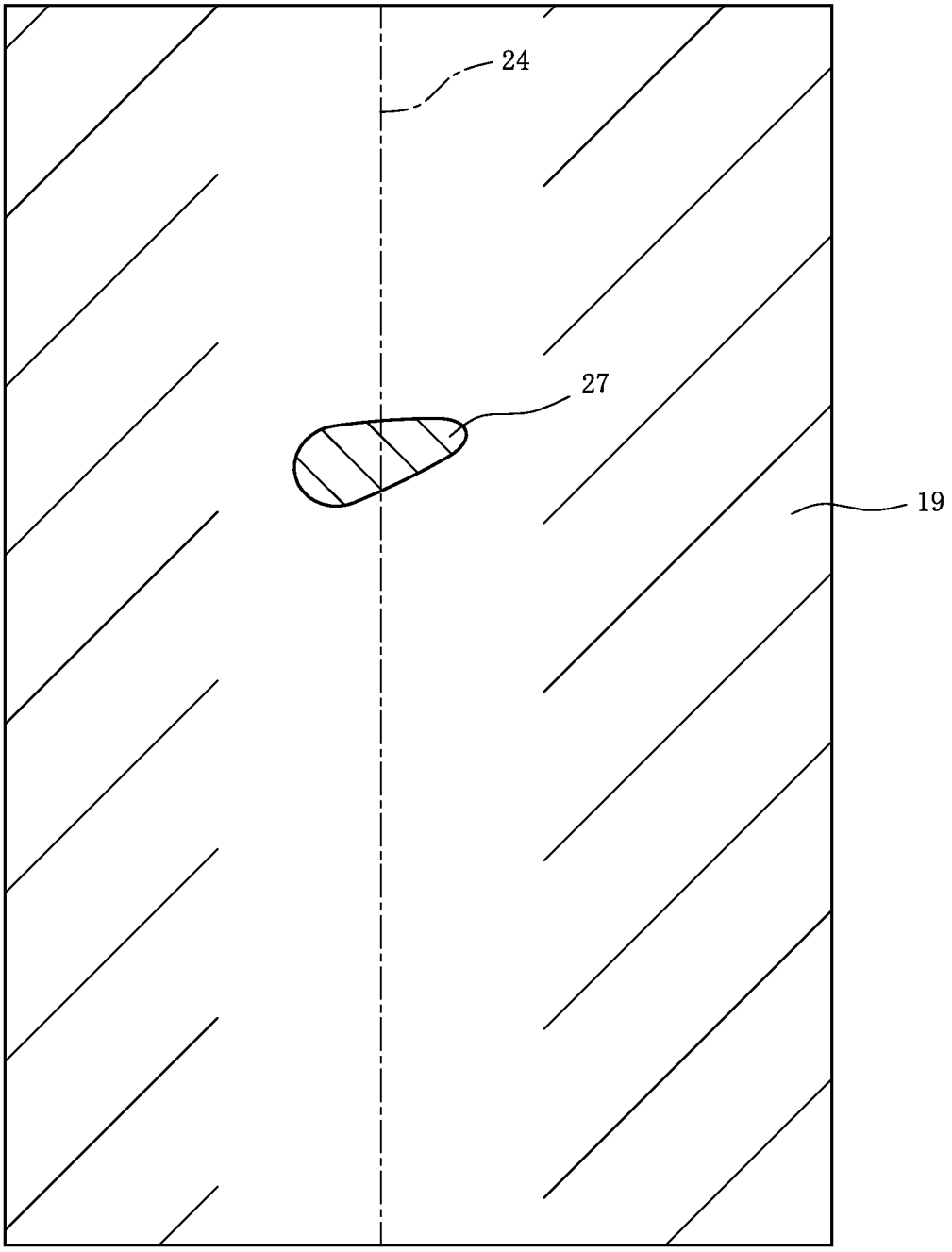
FIG. 4 is a sectional view of a base material.

FIG. 4 is a sectional view of the base material 19. For example, when a segregate 27 of the discharge member 20 or the base material 19 is present on the straight line 24, when a fused portion (not illustrated) is present adjacent to the diffusion layer 25, or when a void (not illustrated) of the base material 19 or the discharge member 20 is present on the straight line 24, that is, when measured values are considered to be influenced by the segregate 27, a void, or the like, two measurement points, instead of the measurement points of the measurement, closest to the measurement points of the measurement and not influenced by the segregate 27, the void, or the like are selected, and an average value of values measured at the two measurement points is employed.

The base material 19 is a solid solution containing Ni. The segregate 27 has a crystal structure that differs from that of the solid solution of the base material 19. The segregate 27 is, for example, an element constituting the base material 19 or impurities, such as carbide, nitride, oxide, and intermetallic compounds. A suitable amount of the segregate 27 helps ensuring the strength of the base material 19.

Incidentally, a spark plug in which at least a portion of a discharge member is bonded to a base material with a diffusion layer interposed therebetween has a problem, when the base material contains Fe, that there is a possibility of the Fe exerting a great influence on the peeling resistance of the discharge member. In other words, when the temperature of a ground electrode is increased under usage environment of the spark plug, oxygen atoms are diffused along the interface between the diffusion layer and the discharge member and the interface between the diffusion layer and the base material and in the inner portion of the diffusion layer. Then, the Fe derived from the base material binds to oxygen and generates an iron oxide. The iron oxide changes in volume in response to the crystal structure thereof being changed by oxidation reduction and thus increases the stress of the diffusion layer. As a result, the discharge member bonded to the base material with the diffusion layer interposed therebetween is caused to peel off easily.

In contrast, in the spark plug in which the discharge member is bonded to the base material with the laser-welded fused portion 26 (refer to FIG. 5) interposed therebetween, a thermal stress generated due to a difference in liner thermal expansion coefficient between the base material and the discharge member is buffered by the fused portion 26. The Fe contained in the base material thus has no great influence on peel-off of the discharge member.

According to the present embodiment, in the spark plug 10 in which at least a portion of the discharge member 20 is bonded to the base material 19 with the diffusion layer 25 interposed therebetween, the base material 19 contains 50 mass % or more of Ni, 8 mass % or more and 40 mass % or less of Cr, 0.05 mass % or more and 2 mass % or less of Si, 0.01 mass % or more and 2 mass % or less of Al, 0.01 mass % or more and 2 mass % or less of Mn, 0.01 mass % or more and 0.1 mass % or less of C, and 0.001 mass % or more and 0.04 mass % or less of Fe.

The content ratio (mass %) of each element of the base material 19 is calculated on the basis of analysis results of mass composition by WDS analysis of a FE-EPMA at the five measurement points having the measurement point C (refer to FIG. 2) as the base point. The content ratio (mass %) of each element of the base material 19 may be calculated from the five measurement points having the measurement point F (refer to FIG. 2), instead of the measurement point C, as the base point. In short, measurement can be performed at any part as long as measured values that represent the composition of the base material 19 before bonding are obtainable.

By containing 50 mass % or more of Ni, the base material 19 can ensure heat resisting properties of the base material 19. By containing 8 mass % or more and 40 mass % or less of Cr, it is possible to ensure oxidation resistance of the base material 19 due to a Cr oxide film formed on the surface of the base material 19 and to suppress generation of the segregate 27, such as Cr Nitride and Cr carbide. By containing 0.05 mass % or more and 2 mass % or less of Si, it is possible to ensure oxidation resistance of the base material 19 and to suppress generation of the segregate 27 constituted by a Si compound. By containing 0.01 mass % or more and 2 mass % or less of Al, it is possible to ensure high-temperature strength and high-temperature corrosion resistance.

By containing 0.01 mass % or more and 2 mass % or less of Mn, the base material 19 can prevent the base material 19 from becoming brittle due to desulfurization and can suppress generation of the segregate 27, such as Mn sulfide. By containing 0.01 mass % or more and 0.1 mass % or less of C, it is possible to ensure high-temperature strength and to suppress generation of the segregate 27, such as Cr carbide. By containing 0.001 mass % or more and 0.04 mass % or less of Fe, it is possible to suppress generation of iron oxide.

The content ratios of elements of the base material 19 other than Ni, Cr, Si, Al, Mn, C, and Fe, and the content ratios of inevitable impurity elements are preferably 1 mass % or less in total and more preferably 0.4 mass % or less in total.

The base material 19 contains 0.001 mass % or more and 0.04 mass % or less of Fe and contains 0.05 mass % or more and 2 mass % or less of Si having higher affinity for oxygen than Fe. Due to that the Si that has higher affinity for oxygen than Fe and that is easily diffused in a part exposed in a combustion chamber (not illustrated) of the engine is contained more than Fe, oxygen preferentially binds to the Si derived from the base material 19, and an oxide film of the Si is generated along the interface between the diffusion layer 25 and the discharge member 20 and the interface between the diffusion layer 25 and the base material 19 and on the diffusion layer 25. By the presence of the oxide film of the Si, it is possible to suppress generation of an iron oxide in which oxygen binds to the Fe derived from the base material 19.

Moreover, due to the content ratio of Si being 2 mass % or less, it is possible to suppress generation of the iron oxide while suppressing the base material 19 from becoming brittle. Therefore, it is possible to ensure the strength of the base material 19 and to further reduce the stress of the diffusion layer 25 caused by the volume change of the iron oxide. As a result, it is possible to avoid the discharge member 20 from peeling off easily.

When the content ratio of Si of the base material 19 is represented by X (mass %) and the content ratio of Fe of the base material 19 is represented by Y (mass %), a ratio X/Y is preferably $X/Y \geq 2.5$. This is to improve the effect of suppressing the oxidization of Fe and the volume change of the iron oxide by Si contained in the base material 19 and to thereby further avoid the discharge member 20 from peeling off easily.

The area of the segregate 27 occupying the area of the base material 19 is preferably 0.01% or more and 4% or less in the cross-section of the base material 19. This is to prevent the base material 19 from becoming brittle and ensure the strength of the base material 19. If the area of the segregate 27 is 0.01% or more, the high-temperature strength of the base material 19 is further increased, and the base material 19 is thus avoided from becoming easily deformable. Consequently, the oxide film generated on the part exposed in the combustion chamber of the engine is avoided from peeling off easily. It is thus possible to further suppress generation of the iron oxide in response to the oxygen atoms being diffused along the interface between the diffusion layer 25 and the discharge member 20 and the interface between the diffusion layer 25 and the base material 19 and in the inner portion of the diffusion layer 25. When the area of the segregate 27 is 4% or less, the base material 19 is suppressed from becoming brittle. Therefore, when the area of the segregate 27 is 0.01% or more and 4% or less, it is possible by ensuring the high-temperature strength of the base material 19 to further avoid the discharge member 20 from peeling off easily.

The segregate 27 can be detected through mapping or analysis of composition images by an EPMA loaded with a wavelength-dispersive X-ray spectrometer detector (WDX or WDS), a SEM attached with an energy dispersive X-ray spectrometer detector (EDX or EDS), or the like. After photographing a cross-section of the base material 19 in a rectangular visual field having a size of 400 μm×600 μm, the area (%) of the segregate 27 occupying the area of the base material 19 is obtained through image processing.

EXAMPLES

The present invention will be more specifically described with an example. The present invention is, however, not limited by the example.

(Forming Samples 1 to 45)

An examiner prepared various types of the base materials 19 having the compositions indicated in Table 1, and the disc-shaped discharge member 20 constituted by Pt: 80 mass %, Rh: 20 mass %, and inevitable impurities of a detection limit or less. The examiner bonded the discharge member 20 to the base materials 19 by resistance welding and obtained the spark plugs 10 of samples 1 to 45. For each sample, a plurality of samples formed under the same conditions were prepared for cross-sectional observation of the base material and the like, in addition to evaluation of peeling resistance, to be performed for each sample. The thickness T of the diffusion layer 25 formed between the base material 19 and the discharge member 20 was less than 70 μm in all of the samples.

TABLE 1

| | Base Material (mass %) | | | | | | | | | Si/Fe | | Peel-off |
|---|---|---|---|---|---|---|---|---|---|---|---|---|
| No | Ni | Cr | Si | Al | Mn | C | Fe | Ti | Y | (X/Y) | Segragete | Property |
| 1 | 79.5 | 18.0 | 1.00 | 0.90 | 0.50 | 0.035 | 0.020 | — | — | 50.00 | good | B |
| 2 | 75.5 | 22.0 | 1.00 | 0.90 | 0.50 | 0.035 | 0.020 | — | — | 50.00 | good | A |
| 3 | 72.5 | 25.0 | 1.00 | 0.90 | 0.50 | 0.035 | 0.020 | — | — | 50.00 | good | A |
| 4 | 72.1 | 25.0 | 1.00 | 0.90 | 0.50 | 0.035 | 0.020 | 0.3 | 0.1 | 50.00 | bad | B |
| 5 | 69.5 | 28.0 | 1.00 | 0.90 | 0.50 | 0.035 | 0.020 | — | — | 50.00 | good | A |
| 6 | 62.4 | 35.0 | 1.15 | 0.90 | 0.50 | 0.035 | 0.020 | — | — | 57.50 | good | B |
| 7 | 52.5 | 45.0 | 1.00 | 0.90 | 0.50 | 0.035 | 0.020 | — | — | 50.00 | good | E |
| 8 | 73.5 | 25.0 | 0.05 | 0.90 | 0.50 | 0.035 | 0.040 | — | — | 1.25 | good | C |
| 9 | 73.0 | 25.0 | 0.50 | 0.90 | 0.50 | 0.035 | 0.020 | — | — | 25.00 | good | B |
| 10 | 72.8 | 25.0 | 0.70 | 0.90 | 0.50 | 0.035 | 0.020 | — | — | 35.00 | good | A |
| 11 | 72.5 | 25.0 | 1.00 | 0.90 | 0.50 | 0.035 | 0.020 | — | — | 50.00 | good | A |
| 12 | 72.2 | 25.0 | 1.30 | 0.90 | 0.50 | 0.035 | 0.020 | — | — | 65.00 | good | A |
| 13 | 72.0 | 25.0 | 1.50 | 0.90 | 0.50 | 0.035 | 0.020 | — | — | 75.00 | good | B |
| 14 | 71.6 | 25.0 | 2.00 | 0.90 | 0.50 | 0.035 | 0.005 | — | — | 400.00 | good | B |
| 15 | 71.5 | 25.0 | 2.00 | 0.90 | 0.50 | 0.035 | 0.020 | — | — | 100.00 | good | B |
| 16 | 71.3 | 25.0 | 2.20 | 0.90 | 0.50 | 0.035 | 0.020 | — | — | 110.00 | good | E |
| 17 | 73.4 | 25.0 | 1.00 | 0.01 | 0.50 | 0.035 | 0.020 | — | — | 50.00 | good | B |
| 18 | 73.1 | 25.0 | 1.00 | 0.30 | 0.50 | 0.035 | 0.020 | — | — | 50.00 | good | B |
| 19 | 72.8 | 25.0 | 1.00 | 0.60 | 0.50 | 0.035 | 0.020 | — | — | 50.00 | good | A |
| 20 | 72.2 | 25.0 | 1.00 | 1.20 | 0.50 | 0.035 | 0.020 | — | — | 50.00 | good | A |
| 21 | 72.0 | 25.0 | 1.00 | 1.40 | 0.50 | 0.035 | 0.020 | — | — | 50.00 | good | B |

TABLE 1-continued

| | Base Material (mass %) | | | | | | | | | Si/Fe | | Peel-off |
|---|---|---|---|---|---|---|---|---|---|---|---|---|
| No | Ni | Cr | Si | Al | Mn | C | Fe | Ti | Y | (X/Y) | Segragete | Property |
| 22 | 71.5 | 25.0 | 1.00 | 2.00 | 0.50 | 0.010 | 0.020 | — | — | 50.00 | good | B |
| 23 | 71.2 | 25.0 | 1.00 | 2.20 | 0.50 | 0.035 | 0.020 | — | — | 50.00 | good | E |
| 24 | 73.6 | 25.0 | 0.70 | 0.60 | 0.01 | 0.035 | 0.020 | — | — | 35.00 | good | B |
| 25 | 72.9 | 25.0 | 1.00 | 0.90 | 0.10 | 0.035 | 0.020 | — | — | 50.00 | good | A |
| 26 | 71.9 | 25.0 | 1.00 | 0.90 | 1.10 | 0.035 | 0.020 | — | — | 50.00 | good | A |
| 27 | 71.8 | 25.0 | 1.00 | 0.90 | 1.20 | 0.035 | 0.020 | — | — | 50.00 | good | B |
| 28 | 71.0 | 25.0 | 1.00 | 0.90 | 2.00 | 0.035 | 0.020 | — | — | 50.00 | good | B |
| 29 | 70.5 | 25.0 | 1.00 | 0.90 | 2.50 | 0.035 | 0.020 | — | — | 50.00 | good | E |
| 30 | 72.6 | 25.0 | 1.00 | 0.90 | 0.50 | 0.010 | 0.020 | — | — | 50.00 | good | A |
| 31 | 72.4 | 25.0 | 1.00 | 0.90 | 0.50 | 0.070 | 0.020 | 0.1 | — | 50.00 | good | A |
| 32 | 72.4 | 25.0 | 1.00 | 0.90 | 0.50 | 0.070 | 0.020 | 0.1 | — | 50.00 | bad | B |
| 33 | 72.5 | 25.0 | 1.00 | 0.90 | 0.50 | 0.100 | 0.020 | — | — | 50.00 | bad | C |
| 34 | 72.4 | 25.0 | 1.00 | 0.90 | 0.50 | 0.150 | 0.020 | — | — | 50.00 | bad | E |
| 35 | 89.6 | 8.0 | 0.20 | 0.10 | 2.00 | 0.060 | 0.040 | — | — | 5.00 | good | B |
| 36 | 58.3 | 40.0 | 0.20 | 0.90 | 0.50 | 0.035 | 0.040 | — | — | 5.00 | good | B |
| 37 | 91.2 | 8.0 | 0.10 | 0.10 | 0.50 | 0.085 | 0.040 | — | — | 2.50 | bad | C |
| 38 | 91.9 | 8.0 | 0.05 | 0.01 | 0.01 | 0.010 | 0.040 | — | — | 1.25 | good | D |
| 39 | 92.6 | 5.0 | 0.20 | 0.10 | 2.00 | 0.060 | 0.040 | — | — | 5.00 | good | E |
| 40 | 51.3 | 41.0 | 2.50 | 2.50 | 2.50 | 0.150 | 0.040 | — | — | 62.50 | good | E |
| 41 | 91.1 | 8.0 | 0.15 | 0.10 | 0.50 | 0.060 | 0.050 | — | — | 3.00 | good | E |
| 42 | 74.6 | 15.0 | 0.20 | 1.40 | 0.80 | 0.035 | 8.000 | — | — | 0.03 | good | E |
| 43 | 60.6 | 23.0 | 0.20 | 1.40 | 0.80 | 0.035 | 14.000 | — | — | 0.01 | good | E |
| 44 | 87.3 | 8.0 | 2.50 | 0.10 | 2.00 | 0.035 | 0.040 | — | — | 62.50 | good | E |
| 45 | 86.7 | 8.0 | 0.20 | 3.00 | 2.00 | 0.060 | 0.040 | — | — | 5.00 | good | E |

In Table 1, the ratio X/Y, where X (mass %) represents the content ratio of Si of the base material and Y (mass %) represents the content ratio of Fe of the base material, is indicated. In addition, after photographing a cross-section of the base material 19 in a rectangular visual field having a size of 400 μm×600 μm, the area (%) of the segregate 27 occupying the area of the base material 19 was obtained through image processing. In the column of segregate in Table 1, the samples in which the value thereof was 0.01% or more and 4% or less and the samples in which the value thereof was less than 0.01%, or more than 4% are indicated as "good" and "bad", respectively.

(Peeling Resistance Test)

The examiner conducted 100 hours of a test in which each sample was attached to each cylinder of a 4-cylinder 2-liter engine and each sample was repeatedly subjected to application of a load of 4000 rpm for one minute followed by application of a load of an idling rotation speed for one minute. The temperature of the discharge member 20 at 4000 rpm was 950° C. By using a spark plug in which a hole reaching the vicinity of the discharge member 20 was formed, the temperature of the discharge member 20 was measured, before starting the peeling resistance test, with the temperature measuring junction of a thermocouple disposed at a front end portion of the base material 19 near the discharge member 20. The amount of energy supplied from an ignition coil to each sample in one spark discharge was 100 mJ.

After the tests, with the use of a SEM, each sample was subjected to observation of a cross-section of the ground electrode 18 including, of the straight lines 24 passing through the center 23 of the discharge surface 21 of the discharge member 20, the straight line 24 parallel to the axis O, and lengths L1 and L2 of cracks each developed from both ends of the diffusion layer 25 toward the center of the diffusion layer 25 were measured. Value M obtained by dividing a total value of L1+L2 of the lengths of the cracks by a length L of the discharge surface 21, that is (L1+L2)/L, was obtained, and classification into five ranks from A to E was performed on the basis of the value M. The criterion was as follows: A: M<20%, B: 20%≤M<30%, C: 30%≤M<40%, D: 40%≤M<50%, and E: M≥50% or the discharge member 20 came off. The results of the peeling resistance tests are indicated in the column of peel-off property in Table 1.

As indicated in Table 1, the samples 7, 16, 23, 29, 34, and 39 to 45 were evaluated as E in the peeling resistance test. In the sample 7, the content ratio of Cr was more than 40 mass %. In the sample 16, the content ratio of Si was more than 2 mass %. In the sample 23, the content ratio of Al was more than 2 mass %. In the sample 29, the content ratio of Mn was more than 2 mass %. In the sample 34, the content ratio C was more than 0.1 mass %. In the sample 39, the content ratio of Cr was less than 8 mass %.

In the sample 40, the content ratio of Cr was more than 40 mass %, the content ratio of each of Si, Al, and Mn was more than 2 mass %, and the content ratio of C was more than 0.1 mass %. In the samples 41 to 43, the content ratio of Fe was more than 0.04 mass %. In the sample 44, the content ratio of Si was more than 2 mass %. In the sample 45, the content ratio of Al was more than 2 mass %.

The samples 1 to 7 differ from each other mainly in the content ratio of Cr. The samples 1 to 6 were evaluated as A or B in the peeling resistance test. The samples 2, 3, and 5 were evaluated as A, and the samples 1, 4, and 6 were evaluated as B. The content ratio of Cr was 8 mass % or more and less than 22 mass % in the sample 1 and was more than 28 mass % and less than or equal to 40 mass % in the sample 6. In the sample 4, the area of the segregate was not 0.01% or more and 4% or less.

The samples 8 to 16 differ from each other mainly in the content ratio of Si. The samples 8 to 15 were evaluated as A, B, or C in the peeling resistance test. The samples 10 to 12 were evaluated as A, the samples 9 and 13 to 15 were evaluated as B, and the sample 8 was evaluated as C. The content ratio of Si was 0.05 mass % or more and less than 0.7 mass % in the samples 8 and 9 and was more than 1.3 mass % and less than or equal to 2 mass % in the samples 13 to 15. In addition, the sample 8 satisfied X/Y<2.5.

The samples 17 to 23 differ from each other mainly in the content ratio of Al. The samples 17 to 22 were evaluated as A or B in the peeling resistance test. The samples 19 and 20 were evaluated as A, and the samples 17, 18, 21, and 22 were evaluated as B. The content ratio of Al was 0.01 mass % or more and less than 0.6 mass % in the samples 17 and 18 and was more than 1.2 mass % and less than or equal to 2 mass % in the samples 21 and 22.

The samples 24 to 29 differ from each other mainly in the content ratio of Mn. The samples 24 to 28 were evaluated as A or B in the peeling resistance test. The samples 25 and 26 were evaluated as A, and the samples 24, 27, and 28 were evaluated as B. The content ratio of Mn was 0.01 mass % or more and less than 0.1 mass % in the sample 24 and was more than 1.1 mass % and less than or equal to 2 mass % in the samples 27 and 28.

The samples 30 to 34 differ from each other mainly in the content ratio of C. The samples 30 to 33 were evaluated as A, B, or C in the peeling resistance test. The samples 30 and 31 were evaluated as A, the sample 32 was evaluated as B, and the sample 33 was evaluated as C. In the sample 32, the area of the segregate was not 0.01% or more and 4% or less. In the sample 33, the content ratio of C was more than 0.07 mass % and less than or equal to 0.1 mass %, and the area of the segregate was not 0.01% or more and 4% or less.

The samples 35 to 38 were evaluated as B, C, or D in the peeling resistance test. The samples 35 and 36 were evaluated as B, the sample 37 was evaluated as C, and the sample 38 was evaluated as D. In the sample 35, the content ratio of Al was 0.01 mass % or more and less than 0.6 mass %, and the content ratio of Mn was more than 1.1 mass % and less than or equal to 2 mass %. In the sample 36, the content ratio of Cr was more than 28 mass % and less than or equal to 40 mass %. In the sample 37, the content ratio of Al was 0.01 mass % or more and less than 0.6 mass %, and the area of the segregate was not 0.01% or more and 4% or less. In the sample 38, the content ratio of Al was 0.01 mass % or more and less than 0.6 mass %, the content ratio of Mn was 0.01 mass % or more and less than 0.1 mass %, and $X/Y<2.5$ was satisfied.

The samples 2, 3, 5, 10 to 12, 19, 20, 25, 26, 30, and 31, which were evaluated as A, each contained 50 mass % or more of Ni, 22 mass % or more and 28 mass % or less of Cr, 0.7 mass % or more and 1.3 mass % or less of Si, 0.6 mass % or more and 1.2 mass % or less of Al, 0.1 mass % or more and 1.1 mass % or less of Mn, 0.01 mass % or more and 0.07 mass % or less of C, and 0.001 mass % or more and 0.04 mass % or less of Fe and satisfied $X/Y\geq 2.5$. In each of these samples, the area of the segregate was 0.01% or more and 4% or less.

The example revealed that, as a result of the base material containing 50 mass % or more of Ni, 8 mass % or more and 40 mass % or less of Cr, 0.05 mass % or more and 2 mass % or less of Si, 0.01 mass % or more and 2 mass % or less of Al, 0.01 mass % or more and 2 mass % or less of Mn, 0.01 mass % or more and 0.1 mass % or less of C, and 0.001 mass % or more and 0.04 mass % or less of Fe, evaluation as any one of A to D is obtainable in the peeling resistance test.

Further, it was revealed that, as a result of the base material containing 50 mass % or more of Ni, 22 mass % or more and 28 mass % or less of Cr, 0.7 mass % or more and 1.3 mass % or less of Si, 0.6 mass % or more and 1.2 mass % or less of Al, 0.1 mass % or more and 1.1 mass % or less of Mn, 0.01 mass % or more and 0.07 mass % or less of C, and 0.001 mass % or more and 0.04 mass % or less of Fe, evaluation as A or B is obtainable in the peeling resistance test. In addition, it was revealed that, as a result of $X/Y\geq 2.5$ being satisfied and the area of the segregate being 0.01% or more and 4% or less, evaluation as A is obtainable in the peeling resistance test.

The present invention has been described above on the basis of the embodiment. The present invention is, however, not limited by the aforementioned embodiment at all and easily assumed to be able to be variously improved or modified within the spirit of the present invention.

In the embodiment, a case in which the shape of the discharge member 20 is a disc shape has been described; however, the embodiment is not necessarily limited thereto, and it is naturally possible to employ another shape. Other shapes of the discharge member 20 are, for example, a frustum shape, an elliptic cylindrical shape, and prism shapes, such as a triangular prism shape and a quadrangular prism shape.

In the embodiment, a case in which the discharge member 20 is bonded to one end portion of the base material 19 and in which the other end portion of the base material 19 is connected to the metal shell 17 has been described; however, the embodiment is not necessarily limited thereto. It is naturally possible to interpose an intermediate material between the one end portion of the base material 19 and the discharge member 20. In this case, the intermediate material is a portion of the base material 19, and the discharge member 20 is bonded to the intermediate material (base material 19) with the diffusion layer 25 interposed therebetween.

In the embodiment, with the ground electrode 18 presented as an example of the first electrode, the diffusion layer 25 between the base material 19 of the ground electrode 18 and the discharge member 20 has been described; however, the embodiment is not necessarily limited thereto. It is naturally possible to use the center electrode 13 as the first electrode and the ground electrode 18 as the second electrode. In this case, the base material 14 of the center electrode 13 and the discharge member 15 are bonded to each other with the diffusion layer 25 interposed therebetween. As with the aforementioned embodiment, it is possible to suppress the discharge member 15 from peeling off from the base material 14 by making the composition of the base material 14 of the center electrode 13 similar to the composition of the base material 19 of the ground electrode 18.

In the embodiment, a case in which the diffusion layer 25 is formed between the base material 19 and the discharge member 20 by resistance welding has been described; however, the embodiment is not necessarily limited thereto. It is naturally possible to form the diffusion layer 25 by utilizing diffusion of atoms with the base material 19 and the discharge member 20 being in close contact with each other by a degree that minimize plastic deformation under a condition of a temperature less than or equal to the melting points of the base material 19 and the discharge member 20 and to thereby bond (commonly known as diffusion bonding) the base material 19 and the discharge member 20 to each other.

In the embodiment, a case in which the base material 19 bonded to the metal shell 17 is bent has been described. The embodiment is, however, not necessarily limited thereto. It is naturally possible to use a linear base material instead of using the bent base material 19. In this case, the linear base material is bonded to the metal shell 17 with the front-end side of the metal shell 17 extended in the axis O direction such that the base material faces the center electrode 13.

In the embodiment, a case in which the axis O of the center electrode 13 is in coincident with the center 23 of the discharge surface 21 of the discharge member 20 and in which the ground electrode 18 is disposed such that the discharge member 20 faces the center electrode 13 in the axial direction has been described. The embodiment is, however, not necessarily limited thereto, and the positional relation between the ground electrode 18 and the center electrode 13 can be set, as appropriate. Another positional relation between the ground electrode 18 and the center electrode 13 is, for example, an arrangement in which the ground electrode 18 is disposed such that a side surface of the center electrode 13 and the discharge member 20 of the ground electrode 18 face each other.

REFERENCE SIGNS LIST

10 spark plug
13 center electrode (second electrode)
18 ground electrode (first electrode)
19 base material
20 discharge member
22 spark gap
25 diffusion layer
27 segregate

What is claimed is:

1. A spark plug comprising:

a first electrode including a base material and a discharge member having at least a portion thereof bonded to the base material with a diffusing layer interposed therebetween; and a second electrode facing the discharge member with a spark gap interposed therebetween, wherein the base material contains 50 mass % or more of Ni, 8 mass % or more and 40 mass % or less of Cr, 0.05 mass % or more and 2 mass % or less of Si, 0.01 mass % or more and 2 mass % or less of Al, 0.01 mass % or more and 2 mass % or less of Mn, 0.01 mass % or more and 0.1 mass % or less of C, and 0.001 mass % or more and 0.04 mass % or less of Fe.

2. The spark plug according to claim 1, wherein the base material contains 22 mass % or more and 28 mass % or less of Cr, 0.7 mass % or more and 1.3 mass % or less of Si, 0.6 mass % or more and 1.2 mass % or less of Al, 0.1 mass % or more and 1.1 mass % or less of Mn, and 0.01 mass % or more and 0.07 mass % or less of C.

3. The spark plug according to claim 1, wherein, when X (mass %) represents a content ratio of the Si of the base material and Y (mass %) represents a content ratio of the Fe of the base material, $2.5 \leq X/Y$ is satisfied.

4. The spark plug according to claim 3, wherein, when X (mass %) represents the content ratio of the Si of the base material and Y (mass %) represents the content ratio of the Fe of the base material, $2.5 \leq X/Y \leq 400$ is satisfied.

5. The spark plug according to claim 1, wherein the base material includes a solid solution containing Ni, the solid solution including a segregate present therein, and wherein, in a cross-section of the base material, an area of the segregate occupying an area of the base material is 0.01% or more and 4% or less.

* * * * *